US009693129B2

(12) United States Patent
Kamada et al.

(10) Patent No.: US 9,693,129 B2
(45) Date of Patent: Jun. 27, 2017

(54) HEADPHONE TYPE ACOUSTIC APPARATUS

(71) Applicant: SONY CORPORATION, Tokyo (JP)

(72) Inventors: Jo Kamada, Tokyo (JP); Atsuto Ohashi, Tokyo (JP); Asako Kawamura, Tokyo (JP); Yasuhiro Onogi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/910,061

(22) PCT Filed: Jun. 24, 2014

(86) PCT No.: PCT/JP2014/003384
§ 371 (c)(1),
(2) Date: Feb. 4, 2016

(87) PCT Pub. No.: WO2015/022766
PCT Pub. Date: Feb. 19, 2015

(65) Prior Publication Data

US 2016/0182995 A1 Jun. 23, 2016

(30) Foreign Application Priority Data

Aug. 13, 2013 (JP) ..... 2013-168301

(51) Int. Cl.

| | |
|---|---|
| ***H04R 25/00*** | (2006.01) |
| ***H04R 1/10*** | (2006.01) |
| *H04R 5/033* | (2006.01) |
| *H04R 5/02* | (2006.01) |
| *H04R 5/04* | (2006.01) |

(52) U.S. Cl.
CPC ..... *H04R 1/1041* (2013.01); *H04R 1/1075* (2013.01); *H04R 1/1008* (2013.01); *H04R 5/02* (2013.01); *H04R 5/0335* (2013.01); *H04R 5/04* (2013.01); *H04R 2420/01* (2013.01); *H04R 2420/03* (2013.01); *H04R 2460/11* (2013.01)

(58) Field of Classification Search
CPC .... H04R 1/1075; H04R 5/033; H04R 1/1041; H04R 1/1008; H04R 2420/03; H04R 2420/05; H04R 2420/09
USPC ..... 381/370, 371, 74, 19, 376, 109
See application file for complete search history.

(56) References Cited

U.S. PATENT DOCUMENTS

2006/0159279 A1 7/2006 Kuo et al.

FOREIGN PATENT DOCUMENTS

| | | | |
|---|---|---|---|
| GB | 2455141 | A | 6/2009 |
| JP | 2000-316198 | A | 11/2000 |
| JP | 2008-141691 | A | 6/2008 |
| JP | 2010-074831 | A | 4/2010 |
| WO | 2012/024775 | A1 | 3/2012 |

OTHER PUBLICATIONS

Extended European Search Report of EP Patent Application No. 14836491.2, issued on Feb. 14, 2017, 8 pages.

*Primary Examiner* — Sunita Joshi
(74) *Attorney, Agent, or Firm* — Chip Law Group

(57) ABSTRACT

This headphone type acoustic apparatus includes a headband, a pair or slider blocks including one end portions that are slidably attached to both end portions of the headband, a pair of housing blocks that are coupled to other end portions of the pair of slider blocks via coupling portions and each include a headphone unit, and a speaker unit that is disposed in each of the pair of slider blocks.

8 Claims, 8 Drawing Sheets

HEADPHONE TYPE ACOUSTIC APPARATUS

TECHNICAL FIELD

The present technology relates to a headphone type acoustic apparatus integrally including headphones and speaker used for listening to music.

BACKGROUND ART

Most headphones are of so-called closed type. The headphones of this type is an acoustic apparatus configured to produce optimal sound in closed spaces between headphone units and ears. In contrast, a speaker is designed to be used for listening to sound at some distance. The headphones and the speaker are structurally similar. It can be said that the most important difference therebetween is power (sound pressure) for vibrating air. The headphones only need to have power for vibrating air in the closed spaces. On the other hand, the speaker needs high power for vibrating air in a space between the speaker and the user.

Patent Document 1 has disclosed headphones in which the output power of a headphone/speaker is switched between a low level for the headphone and a high level for the speaker by a changeover switch operation. Thus, the headphones have both of headphone and speaker functions.

However, the headphones of Patent Document 1 merely switch the output power of the speaker unit placed in a housing between the low level for the headphone and the high level for the speaker. Therefore, for using the speaker unit as the speaker, it has to be used as a stationary speaker. At this time, a distance between speaker units respectively placed in left and right housings is not sufficient for providing a sufficient stereophonic effect in stereophonic reproduction.

Patent Document 1: Japanese Patent Application Laid-open No. 2010-74831 (paragraph [0019], etc.)

SUMMARY OF INVENTION

Problem to be Solved by the Invention

Regarding a headphone type acoustic apparatus integrally including headphones and a speaker, it has been desirable to improve the performance, for example, the usability and the sound quality of the speaker.

In view of the above-mentioned circumstances, it is an object of the present technology to improve the performance of a headphone type acoustic apparatus integrally including headphones and a speaker.

Means for Solving the Problem

In order to solve the above-mentioned problem, a headphone type acoustic apparatus according to the present technology includes a headband, a pair of slider blocks including one end portions that are slidably attached to both end portions of the headband, a pair of housing blocks that are coupled to other end portions of the pair of slider blocks via coupling portions and each include a headphone unit, and a speaker unit that is disposed in each of the pair of slider blocks.

In the headphone type acoustic apparatus according to the present technology, in addition to the headphone units provided in the pair of housing blocks, the speaker units are provided in the pair of slider blocks. For enjoying music through the speaker units, a portion including the headband and the left and right slider blocks only needs to be mounted on the neck of a user. In this mounted state, the pair of speaker units are located under the left and right ears of the user, and hence sound from the speaker units favorably reaches the ears of the user through a space. Furthermore, the slider blocks include the speaker units, and hence the position relationship between the speaker units and the ears of the user can be adjusted by sliding the slider blocks.

The headphone type acoustic apparatus may further include a first amplifier that is capable of amplifying an audio signal to be supplied to the headphone unit, a second amplifier that is capable of amplifying an audio signal to be supplied to the speaker unit, an operation section that receives a switching instruction from a user, and a control unit that switches between the first amplifier and the second amplifier according to the instruction received by the operation section.

With this, the user can freely switch between the headphone unit and the speaker unit as a unit from which the user wishes to output sound.

The speaker unit may include a speaker driver unit including a diaphragm that is capable of vibrating in a thickness direction of the slider block, a magnetic circuit that drives the diaphragm, and a case that retains and houses the diaphragm and the magnetic circuit with the diaphragm being exposed therefrom, and a lid that forms a space between the lid and a surface of the case, from which the diaphragm is exposed, and includes an opening for spilling sound from one end of the space in a direction orthogonal to a slide direction of the slider block.

The opening is provided for spilling sound from the one end of the space in the direction orthogonal to the slide direction of the slider block, and hence sound from the speaker units in the case where the headphone type acoustic apparatus is used toy being hung on the neck of the user can be emitted to the ears of the user. With this, without greatly increasing the sound volume of the speaker units, the user can hear sound with sufficient volume.

The one end of the space in the direction orthogonal to the slide direction of the slider block is on a front side in a state in which the headphone type acoustic apparatus is worn by the user.

Effects of the Invention

As described above, according to the present technology, it is possible to improve the performance of a headphone type acoustic apparatus integrally including headphones and a speaker.

MODE(S) FOR CARRYING OUT THE INVENTION

Hereinafter, an embodiment to which the present technology is applied will be described with reference to the drawings.

<First Embodiment>

[Configuration of Headphone Type Acoustic Apparatus]

Figure 1:
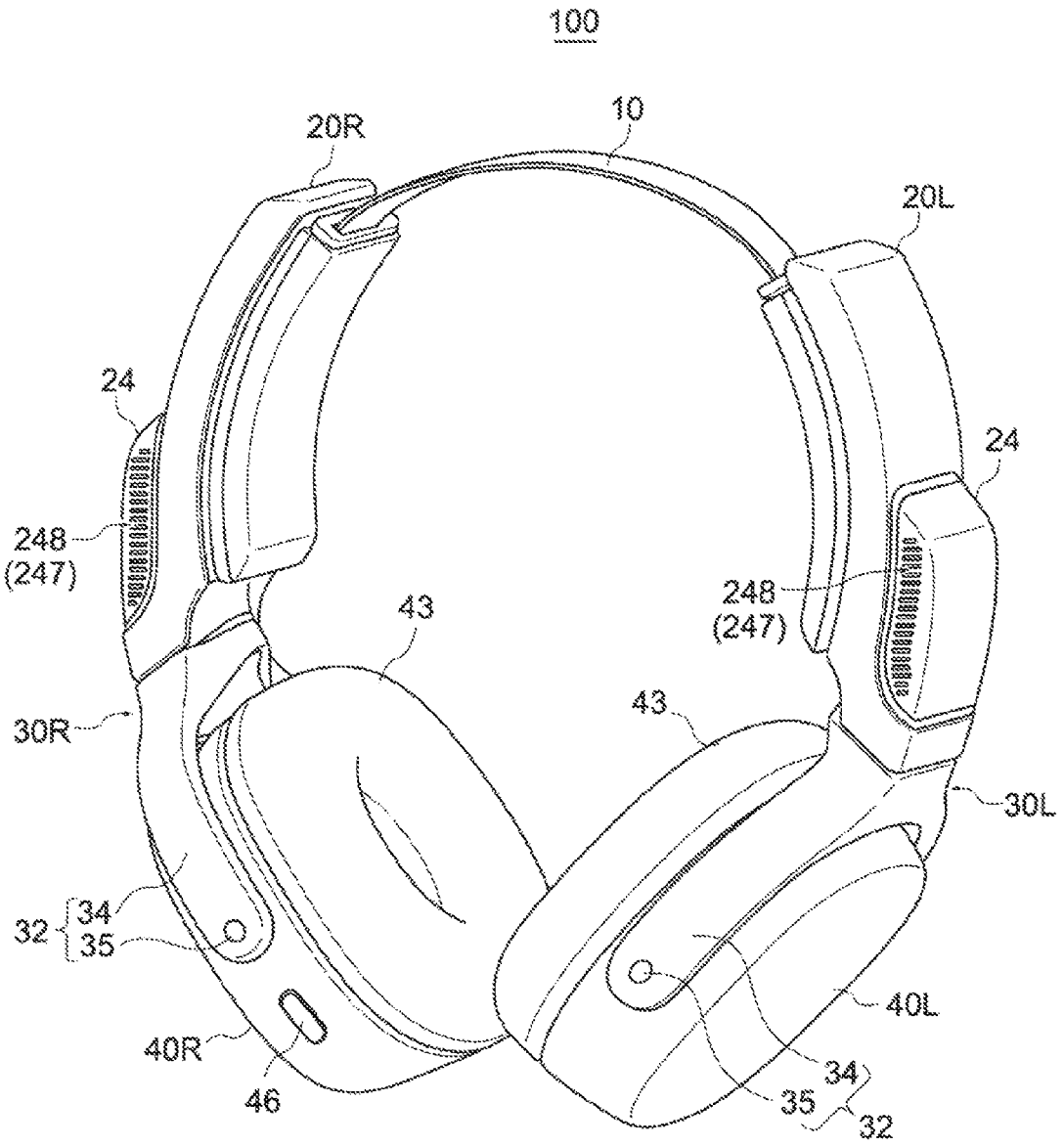
FIG. 1 A diagram showing the outer appearance of a headphone type acoustic apparatus of a first embodiment according to the present technology, FIG. 2 A sectional view showing a configuration of the headphone type acoustic apparatus of FIG. 1.

FIG. 1 is a diagram showing the outer appearance of a headphone type acoustic apparatus of a first embodiment according to the present technology.

As shown in the figure, a headphone type acoustic apparatus 100 includes a headband 10, left and right slider blocks 20R, 20L, left and right hangers 30R, 30L (coupling portions), and left and right housing blocks 40R, 40L.

Note that the symbol "R" indicates the right, the symbol "L" indicates the left, and the left and right are directions as viewed from a user wearing the headphone type acoustic apparatus 100.

For hanging the headband 10 on the head or neck of a human body, the headband 10 is, for example, formed of a flexible thin plate of synthetic resin that is generally curved at an approximately predetermined curvature. The housing blocks 40R, 40L are attached to both ends of the headband 10 via the slider blocks 20R, 20L and the hangers 30R, 30L, respectively.

Figure 2:
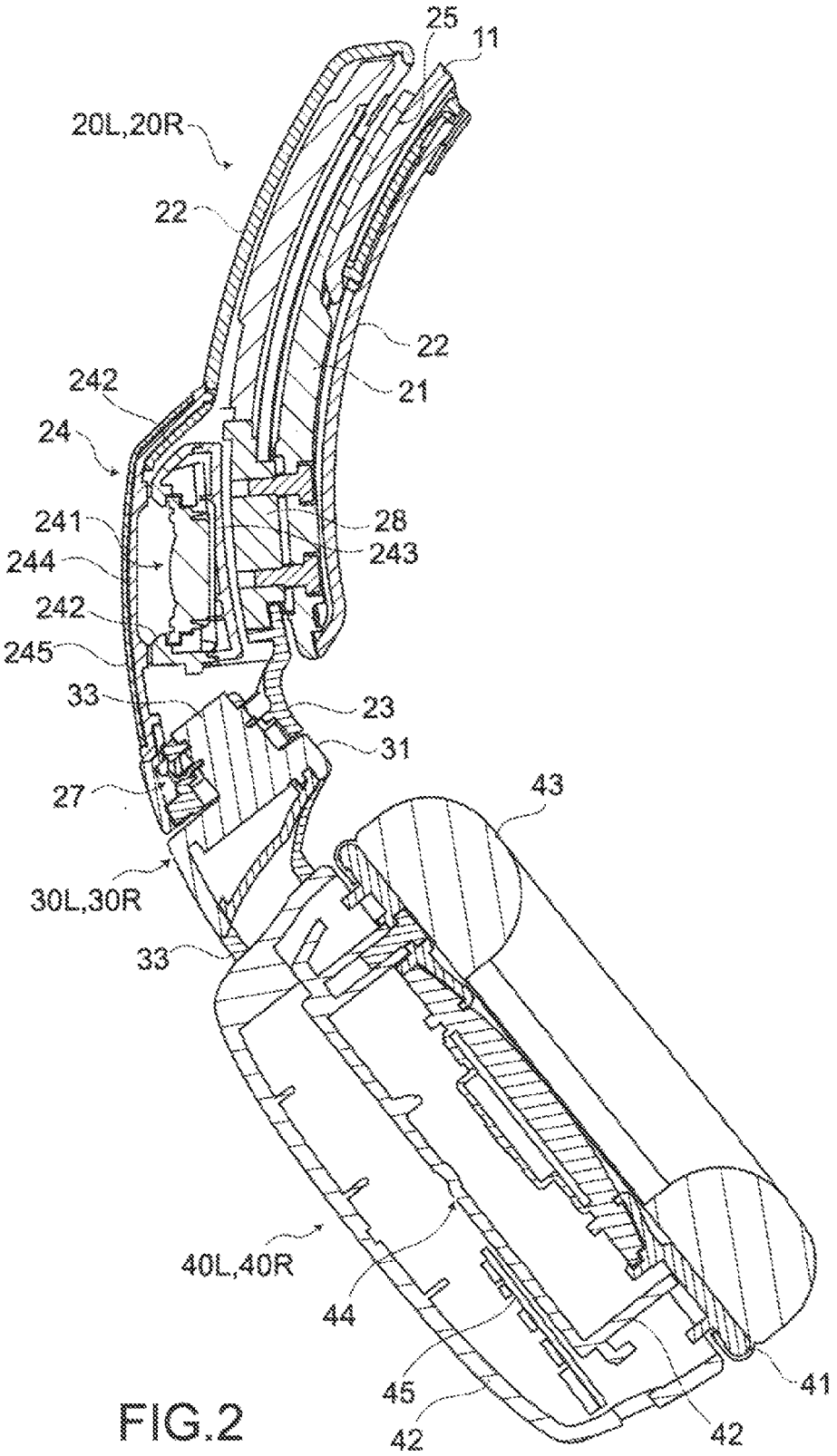

FIG. 2 is a sectional view showing a configuration of the headphone type acoustic apparatus 100 of FIG. 1.

Each of the slider blocks 20R, 20L includes a slider base 21, a slider cover 22, a hanger coupling portion 23, and a speaker unit 24.

For slidably retaining an end portion 11 of the headband 10, the slider base 21 includes an insertion portion 25, a hooking structure (not shown), and the like. The end portion 11 of the headband 10 is inserted into the insertion portion 25. The hooking structure is provided in the insertion portion 25 and locks an insertion position of the headband 10 by hooking a hooking portion (not shown) such protrusion formed on a surface of the end portion 11 of the headband 10. By manually adjusting the amount of insertion of the end portion 11 of the headband 10 depending on needs, the user can fit the housing blocks 40R, 40L onto the left and right ears of the user.

The slider cover 22 is an outer packaging cover for the slider base 21.

The hanger coupling portion 23 is a portion coupled to the hangers 30R, 30L to be described later.

To each of the slider blocks 20R, 20L, fixed is the speaker unit 24 including a group of parts necessary for the headphone type acoustic apparatus 100 of this embodiment to function as a speaker. The term "speaker" as used herein means an acoustic apparatus that transmits sound to the user by vibrating air in a surrounding open space. It is used herein as a term having different meaning from the "headphones" that transmit sound to the user by vibrating air in a space closed by the housing blocks.

The hanger 30R, 30L includes a first coupling portion 31 for coupling to the hanger coupling portion 23 of the slider block 20R, 20L and a second coupling portion 32 (see FIG. 1) for coupling to the housing block 40R, 40L. The first coupling portion 31 includes a shaft portion 33. This shaft portion 33 is coupled to a bearing portion 27 provided in the hanger coupling portion 23 of the slider block 20R, 20L. The bearing portion 27 is a part for rotatably retaining the shaft portion 33 of the first coupling portion 31 of the hanger 30R, 30L. By the shaft portion 33 of the first coupling portion 31 of the hanger 30R, 30L being coupled to the bearing portion 27 of the hanger coupling portion 23 of the slider block 20R, 20L in this manner, the hanger 30R, 30L is coupled to the slider block 20R, 20L to be rotatable around the shaft.

Note that the first coupling portion 31 including the shaft portion 33 is provided integrally with the hanger 30R, 30L, and hence sufficient durability is provided.

On the other hand, the second coupling portions 32 (see FIG. 1) of the hangers 30R, 30L rotatably support the housing blocks 40R, 40L, respectively. This second coupling portion 32 is configured to enable the housing block 40R, 40L to rotate in an axis direction orthogonal to the axis direction of the shaft portion 33 in the above-mentioned first coupling portion 31. The second coupling portion 32 includes a forked portion 34 provided extending from the vicinity of the first coupling portion 31 in a forked state and shaft portions 35 provided in distal ends of the forked portion 34.

The shaft portions 35 are provided protruding from surfaces of the forked portion 34 which are opposed to a housing 42 of the housing block 40R, 40L. The shaft portions 35 of each of the left and right hangers 30R, 30L are arranged to be aligned in a single straight line passing through the center of the housing 42 and substantially function as an integral shaft. The shaft portions 35 of each of the left and right hangers 30R, 30L are inserted into bearing holes (not shown) formed in the housing 42 and retained.

[Configurations of Housing Blocks 40R, 40L]

Next, configurations of the housing blocks 40R, 40L will be described.

Each of the housing blocks 40R, 40L includes a baffle 41, the housing 42, an ear pad 43, a headphone unit 44, a wiring board 45, and the like.

The baffle 41 includes a base material having an approximately disk shape that fixes the housing 42, the ear pad 43, and the headphone unit 44.

The housing 42 is a box having an approximately cylindrical shape for covering the headphone unit 44.

The ear pad 43 is a part having an approximately doughnut shape having cushion properties for covering the ear of the user.

Note that the shapes of the baffle 41, the housing 42, and the ear pad 43 are not limited to the above.

The headphone unit 44 is constituted of a diaphragm for converting electrical signals into vibration of air (sound), a magnetic circuit (e.g., magnet and voice coil), and the like.

The wiring board 45 is a board on which an integrated circuit necessary for realizing the functions of a processor 110, a memory, and otherwise an audio reproduction apparatus and other electronic components are mounted.

Note that, for example, in the housing 42, provided are a slide switch 46 that is a part of a user operation section 114 (see FIG. 8) and otherwise switches such as a push switch and a jog dial.

[Configuration of Speaker Unit]

Next, a configuration of the speaker unit 24 will be described.

In the headphone type acoustic apparatus 100 of this embodiment, the speaker units 24 are provided as devices that output sound in addition to the headphone units 44 in the housing blocks 40R, 40L.

The speaker units 24 are disposed in the left and right slider blocks 20R, 20L, respectively. The speaker unit 24 is provided in a predetermined surface of the slider block 20R, 20L, that is, a surface oriented outward when the headphone type acoustic apparatus 100 is worn by being hung on the head or neck of the user.

Figure 3:
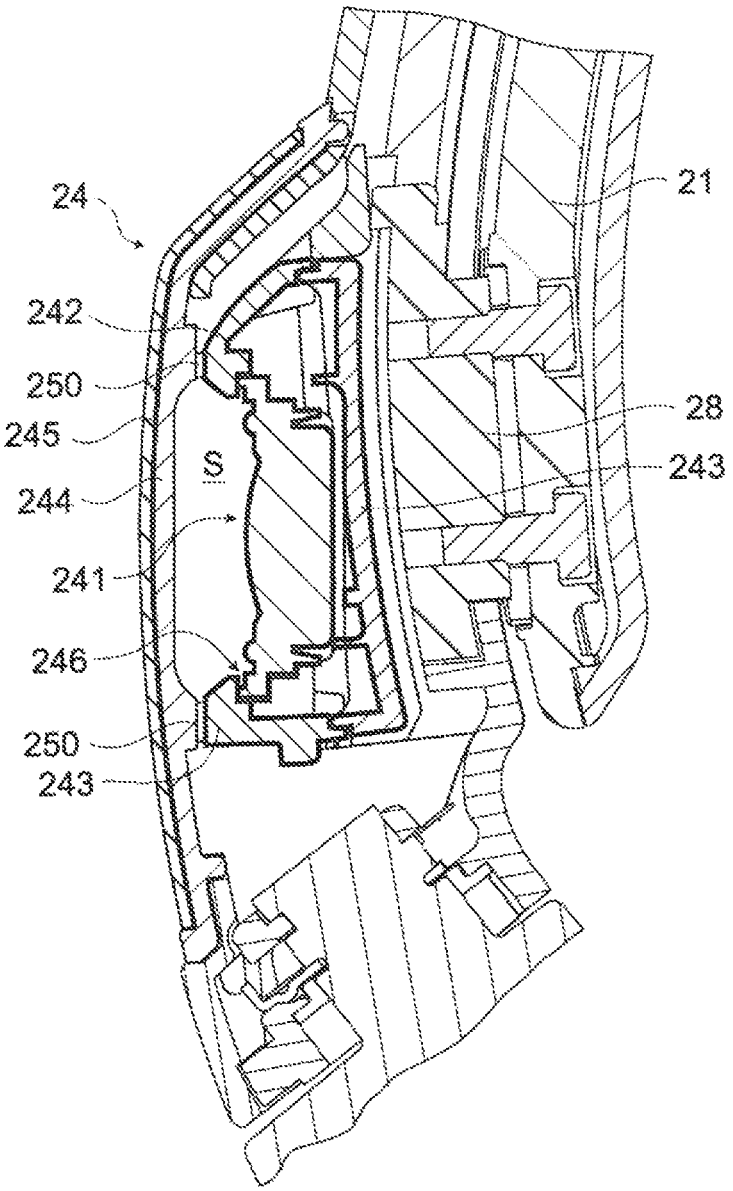
FIG. 3 A longitudinal sectional view of a speaker unit.
Figure 4:
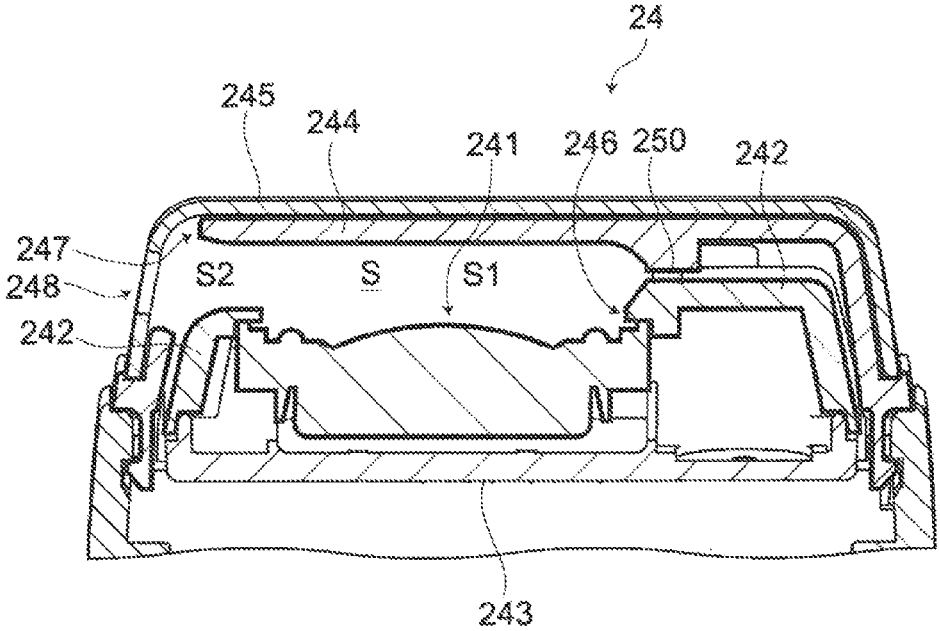
FIG. 4 A transverse sectional view of the speaker unit.
Figure 5:
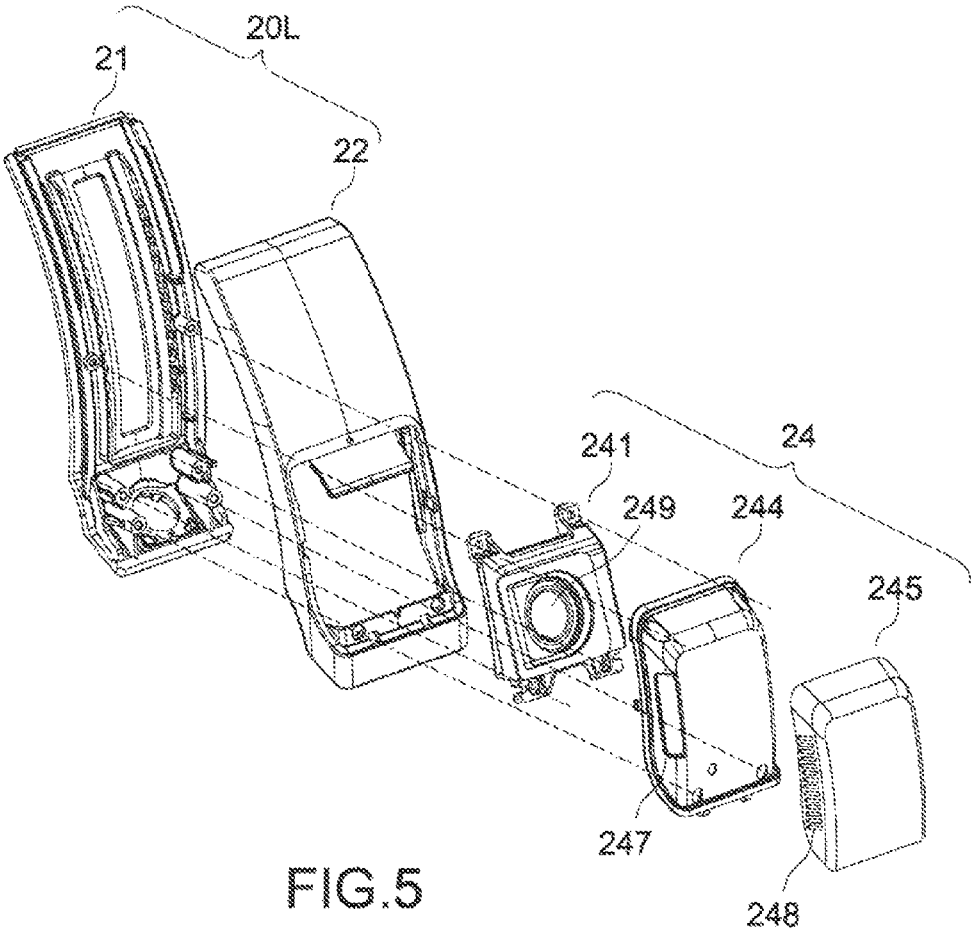
FIG. 5 An outer appearance view showing a configuration of a speaker unit 24 from which a cover and the like are removed.

FIG. 3 is a longitudinal sectional view showing the configuration of the speaker unit 24. FIG. 4 is a transverse sectional view of the speaker unit 24. FIG. 5 is an exploded perspective view showing a part of a configuration of the slider block 20R, 20L including the speaker unit 24.

The speaker unit 24 includes a diaphragm for converting electrical signals into vibration of air (sound), a magnetic circuit (e.g., magnet and voice coil) that drives the diaphragm, a speaker driver unit 241 that is constituted of cases 242, 243 and the like that house them, and a speaker cover 244 and a speaker grille 245 that constitute a lid of the speaker driver unit 241.

The cases 242, 243 are constituted of an upper case 242 and a lower case 243. In the upper case 242, a diaphragm retaining aperture 246 for retaining the periphery of the diaphragm in a state in which the diaphragm (249 in FIG. 5) is exposed is provided. The cases 242, 243 are fixed to a cushion member 28 fixed to the slider base 21 of the slider block 20R, 20L, via coupling parts such as a screw.

The speaker cover 244 is attached above the speaker driver unit 241 so as to form a space between the diaphragm of the speaker driver unit 241 and the surface of the upper case 242.

The speaker grille 245 is a cover part for decoration that further covers the outside of the speaker cover 244.

As shown in FIGS. 3 and 4, a space S is formed between the diaphragm of the speaker driver unit 241 and the surface of the upper case 242 and the speaker cover 244. In order to emit a sound pressure with a predetermined directivity from the inside to the outside of the space S, a sound spill port 247 for spilling sound from the space to the outside is provided in a side surface of the speaker cover 244. In addition, in the speaker grille 245 that covers the outside of the speaker cover 244, formed is a slit output 248 correspondingly to the sound spill port 247 of the speaker cover 244. Thus, the sound pressure output from the speaker driver unit 241 is emitted from the inside to the outside of the space S through the sound spill port 247 provided in the side surface of the speaker cover 244 and the slit opening 248 of the speaker grille 245. In other words, in the lid that collectively refers to the speaker cover 244 and the speaker grille 245, a region in which openings of the sound spill port 247 and the slit opening 248 overlap each other is provided as substantially an opening for spilling sound from the inside to the outside.

Furthermore, such that sound emitted from the diaphragm of the speaker driver unit 241 is smoothly guided to the sound spill port 247 provided in the side surface of the speaker cover 244 and emitted to the outside through them, the speaker cover 244 and the upper case 242 are configured as follows.

1. A most part of a rear surface of the speaker cover 244 (surface opposed to diaphragm and surface of upper case 242) is occupied by a flat surface.

2. The height position of the space S and the height position of the sound spill port 247 were set to be approximately the same.

3. The space S was stopped at a position along a semicircumference on an opposite side of the sound spill port 247 of the speaker driver unit 241. That is, as viewed from a vibration direction of the diaphragm, the space S is constituted of a space portion S1 corresponding to an outer shape of the diaphragm and a space portion S2 that communicates from the space portion S1 to the sound spill port 247 of the speaker cover 244.

In order to configure the space S to have a close structure except for the sound spill port 247, portions in which the surface of the upper case 242 and the rear surface of the speaker cover 244 abut against each other are pressure-welded to each other while sandwiching a cushion sheet 250 therebetween. Note that the cushion sheet 250 serves to prevent vibration of the upper case 242 due to vibration of the diaphragm from being transmitted to the speaker cover 244.

By the way, the side surface in which the sound spill port 247 of the speaker cover 244 is provided means a surface oriented forward in a state in which the headphone type acoustic apparatus 100 is worn by the user. In other words, the sound spill port 247 is provided in an end of the space S, which is in a direction orthogonal to a slide direction of the slider block 20R, 20L. The reason is a s follows.

Figure 6:
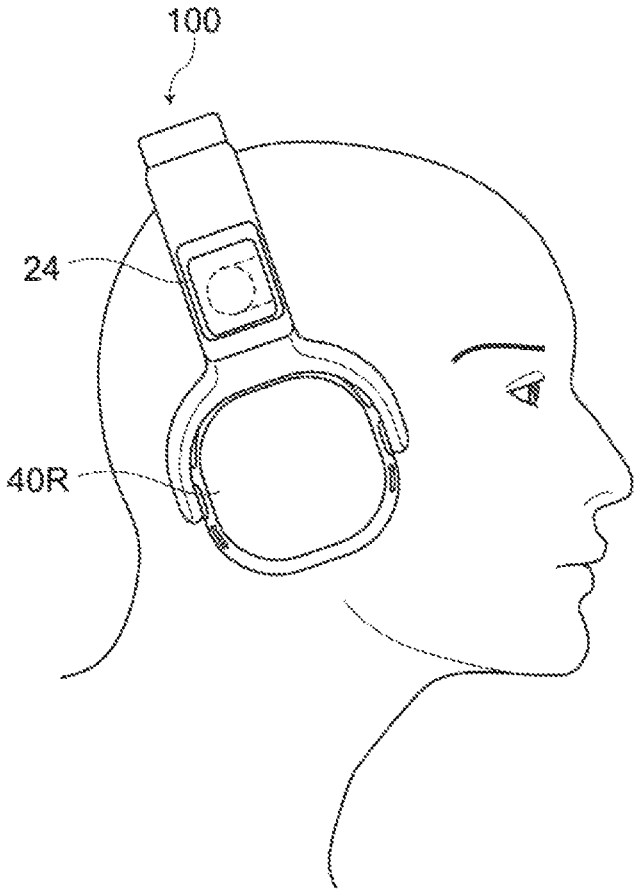
FIG. 6 A diagram showing a head-mounted state of the headphone type acoustic apparatus of this embodiment.

Mainly two kinds of mounted state of the headphone type acoustic apparatus 100 of this embodiment are assumed. One of them is, as shown in FIG. 6, a mounted state during general use of the headphones. Specifically, it is a state in which the left and right housing blocks 40R, 40L are put on the left and right ears of the user. It will be referred to as a "head-mounted state."

Figure 7:
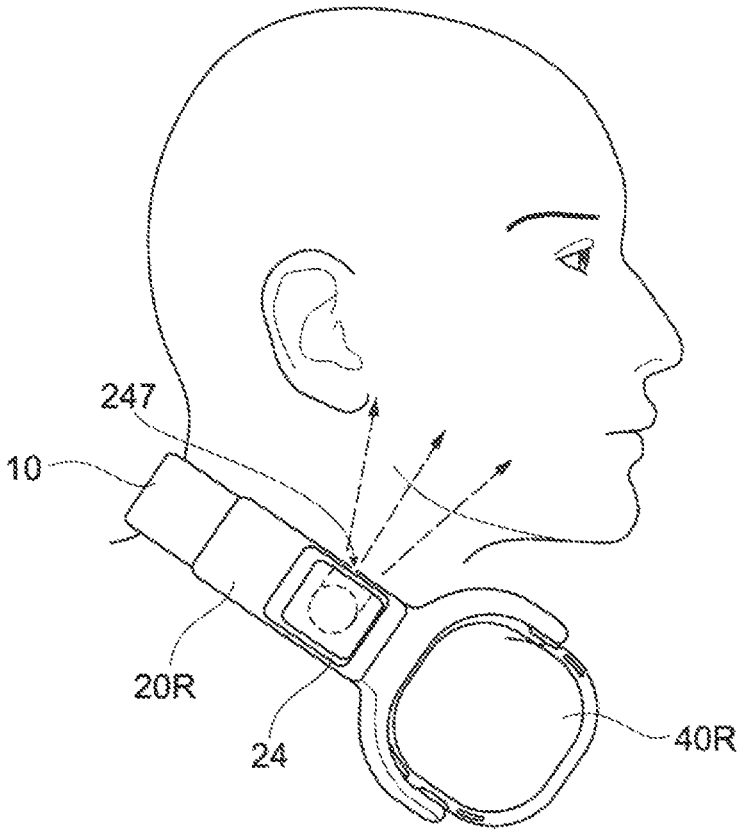
FIG. 7 A diagram showing a neck-mounted state of the headphone type acoustic apparatus of this embodiment.

The other is, for example, as shown in FIG. 7, a state in which the portion of the headband 10 and the left and right slider blocks 20R, 20L is mounted by being hung on the neck of the user. It will be referred to as a "neck-mounted state." In this neck-mounted state, the sound spill ports 247 of the left and right speaker units 24, 24 are located approximately directly under the left and right ears of the user. At this time, the sound spill ports 247 are oriented upward and forward. With this, sound from the left and right speaker units 24, 24 efficiently reaches the left and right ears of the user.

Furthermore, as shown in FIG. 3, the lower case 243 of the speaker unit 24 is fixed and supported to the slider base 21 via the cushion member 28 with the screw or the like. With this, vibration of the speaker unit 24 is prevented from being transmitted to the slider base 21 of the slider block 20R, 20L.

[Electrical Configuration of Headphone Type Acoustic Apparatus 100]

Figure 8:
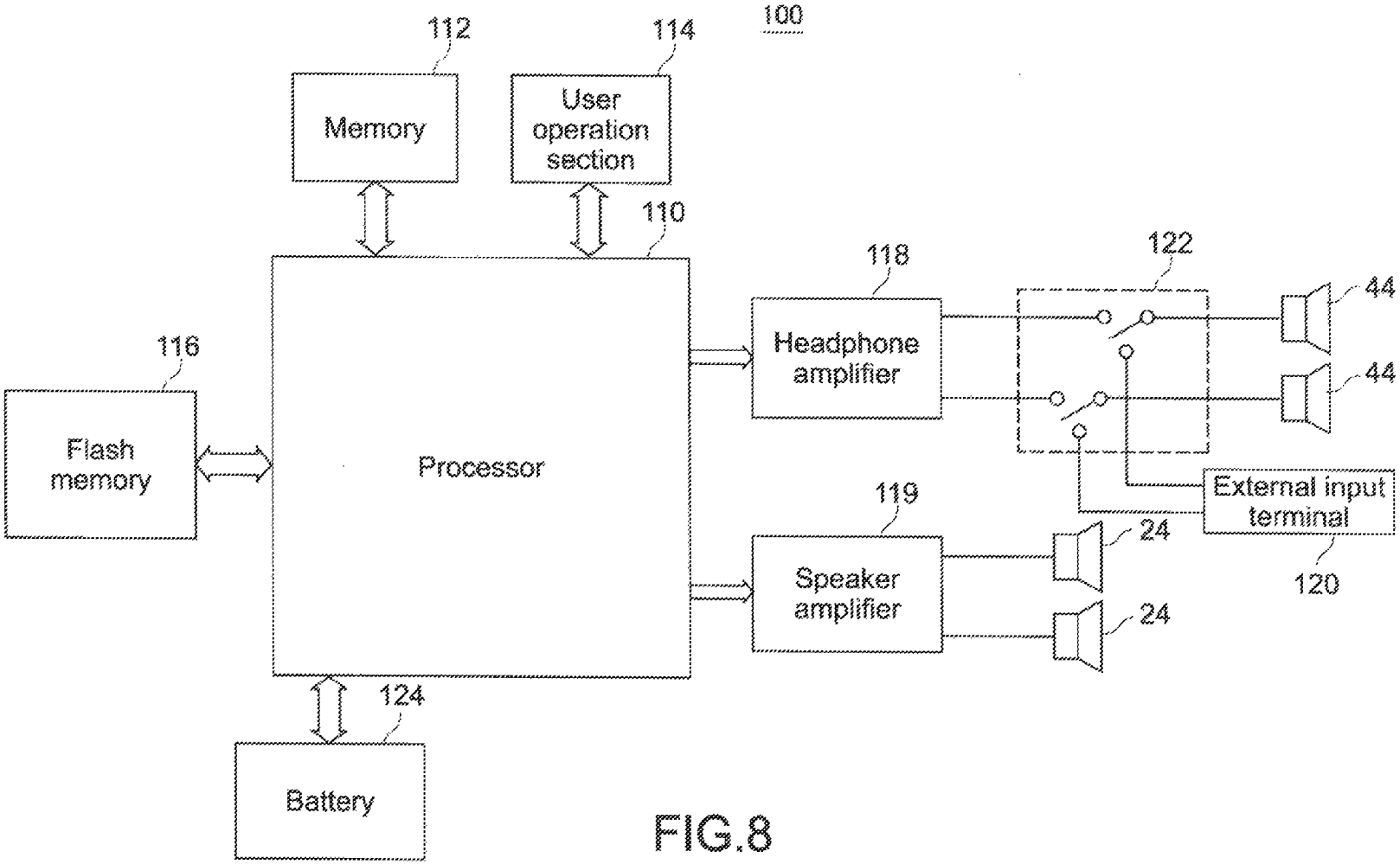
FIG. 8 A diagram showing an electrical configuration of the headphone type acoustic apparatus of this embodiment.

FIG. 8 is a diagram showing an electrical configuration of the headphone type acoustic apparatus 100 of this embodiment.

As shown in the figure, the headphone type acoustic apparatus 100 includes the processor 110, a memory 112, the user operation section 114, a flash memory 116, a headphone amplifier 118, a speaker amplifier 119, the headphone units 44, 44, the speaker units 24, 24, an external input terminal 120, a switching circuit 122, a battery 124, and the like.

The processor 110 (processor) is a control circuit that performs entire control and necessary arithmetic processing and signal processing of the headphone type acoustic apparatus 100 of this embodiment and is constituted of a BGA (Ball Grid Array) and the like.

The memory 112 stores a program and the like to be executed by the processor 110 and is used as a working area of the processor 110 or the like. The memory 112 is constituted of an SDRAM (Synchronous Dynamic Random Access Memory) and the like.

The user operation section 114 is a device that receives an input of an operation from the user, for example, a jog dial, a slide switch, or a push button.

As switches of the user operation section 114, there are on/off switch of a main power source, a sound volume switch, an output changeover switch, and the like. The output changeover switch is a switch for alternatively switching between a headphone output and a speaker output.

The processor 110 detects the state of the output changeover switch and recognizes, based on the result, which of the headphone output and the speaker output has been selected by the user. If it is recognized that the headphone output has been selected by the user, the processor 110 drives the headphone units 44, 44 by bringing the headphone amplifier 118 into an active state. Furthermore, if it is recognized that the speaker output has been selected by the user, the processor 110 drives the speaker units 24, 24 by bringing the speaker amplifier 119 into an active state.

The flash memory 116 is a non-volatile storage device capable of rewriting and deleting, in which audio files and the like are stored as user data, for example.

The headphone amplifier 118 (first amplifier) amplifies an audio signal output from the processor 110 and supplies it to the headphone units 44, 44.

The speaker amplifier 119 (second amplifier) amplifies an audio signal output from the processor 110 and supplies it to the speaker units 24, 24.

The external input terminal 120 is a connection with an external device, for example, a smart phone or a portable audio device.

The switching circuit 122 switches, based on the connection state of the external device with the external input terminal 120, input sources of the headphone units 44, 44 between the headphone amplifier 118 and the external device. Specifically, if the external device is not connected to the external input terminal 120, the input sources of the headphone units 44, 44 are switched to the headphone amplifier 118. If the external device is connected to the external input terminal 120, the input sources of the headphone units 44, 44 are switched to the external device.

The battery 124 stores power for operating the headphone type acoustic apparatus 100 and supplies it. The battery 124 is rechargeable, for example, a lithium battery.

Otherwise, the headphone type acoustic apparatus 100 includes, although not shown in the figure, a display device such as an LED (Light Emitting Diode) for displaying various statuses, a general-purpose interface such as a USB (Universal Serial Bus), and the like.

[Operation of Headphone Type Acoustic Apparatus 100]

In the case where the headphone output is selected according to an operation made by the user with respect to the user operation section 114 (output changeover switch), the processor 110 recognizes the selection contents and brings the headphone amplifier 118 into an active state.

When the user instructs to reproduce a music track through the user operation section 114, the processor 110 reads in an audio file of the music track from the flash memory 116, for example. The processor 110 decodes and modulates it and converts it into an analog signal. The processor 110 supplies the analog audio signal to the headphone amplifier 118. The audio signal amplified by the headphone amplifier 118 is supplied to the headphone units 44, 44 and the headphone units 44, 44 are driven. With this, the user can enjoy music by the headphone output in the head-mounted state.

Furthermore, in the case where the headphone output is selected according to an operation made by the user with respect to the user operation section 114 (output changeover switch), the processor 110 recognizes the selection contents and brings the speaker amplifier 119 into an active state. The processor 110 supplies the analog audio signal generated from the audio file to the speaker amplifier 119. The audio signal amplified by the speaker amplifier 119 is supplied to the speaker units 24, 24 and the speaker units 24, 24 are driven. With this, the user can enjoy music by the speaker output in the neck-mounted state.

Furthermore, in the case where the user operation section 114 is operated by the user to switch to the speaker output while listening to music by the headphone output, the processor 110 switches the headphone amplifier 118 to an inactive state and switches the speaker amplifier 119 to an active state. In other words, in this headphone type acoustic apparatus 100, an operation made by the user with respect to the user operation section 114 can always switch from listening to music by the headphone output to listening to music by the speaker output. The same applies to the case of switching from the speaker output to the headphone output.

As described above, in the headphone type acoustic apparatus 100 of this embodiment, in addition to the headphone units 44, 44 provided in the left and right housing blocks 40R, 40L, respectively, the speaker units 24, 24 are provided in the left and right slider blocks 20R, 20L. For enjoying music through the speaker units 24, 24, as shown in FIG. 7, the user is recommended to use it in the neck-mounted state through a product manual or the like. In this neck-mounted state, the sound spill ports 247 of the left and right speaker units 24, 24 are located approximately under the left and right ears of the user and oriented approximately upward. That is, sound from the left and right speaker units 24, 24 is emitted to the ears of the user from below. Therefore, without greatly increasing the sound volume of the speaker units 24, 24, the user can hear sound with sufficient volume.

Figure 9:
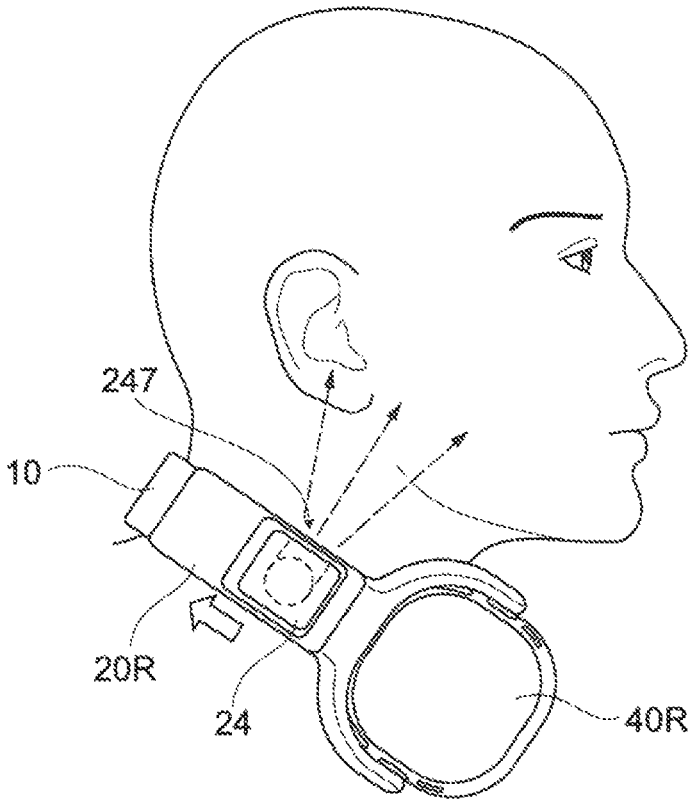
FIG. 9 A diagram showing a method of adjusting speaker positions.

In addition, the entire size of the headband 10 and the slider blocks 20R, 20L can be manually changed by the user depending on needs. Therefore, for example, as shown in FIG. 9, the position relationship between the left and right ears of the user and the left and right speaker units 24, 24 can be freely adjusted by changing the locking position to a position at which the headband 10 is slightly pulled out of the slider blocks 20R, 20L or changing the locking position to a position at which the headband 10 is slightly pushed into the slider blocks 20R, 20L conversely.

Furthermore, during use of the speaker, the ears are not closed unlike use of the headphones, and hence the user can hear surrounding sound as well as music. Therefore, the safety of the moving user can be enhanced.

[Effects in Comparison with Patent Document 1]

1. The user can listen to sound from the left and right speaker units 24, 24 by the left and right ears with the headphone type acoustic apparatus 100 being mounted on the neck during use of the speaker. Thus, a favorable stereo effect can be provided in comparison with a case of listening to sound from the left and right housing blocks at a long distance like the one described in Patent Document 1.

2. In the headphone type acoustic apparatus 100 of this embodiment, sound is transmitted through a space between the speaker unit 24 and the ear. Thus, it is possible to enjoy natural speaker sound in comparison with a method of switching the output power of the speaker unit provided in the housing between the low level for the headphones and the high level for the speaker.

Note that the present technology may also take the following configurations.

(1) A headphone type acoustic apparatus, including:

a headband;

a pair of slider blocks including one end portions that are slidably attached to both end portions of the headband;

a pair of housing blocks that are coupled to other end portions of the pair of slider blocks via coupling portions and each include a headphone unit; and a speaker unit that is disposed in each of the pair of slider blocks.

(2) The headphone type acoustic apparatus according to (1), further including:

a first amplifier that is capable of amplifying an audio signal to be supplied to the headphone unit;

a second amplifier that is capable of amplifying an audio signal to be supplied to the speaker unit;

an operation section that receives a switching instruction from a user; and a control unit that switches between the first amplifier and the second amplifier according to the instruction received by the operation section.

(3) The headphone type acoustic apparatus according to (1) or (2), in which the speaker unit includes a speaker driver unit including a diaphragm that is capable of vibrating in a thickness direction of the slider block, a magnetic circuit that drives the diaphragm, and a case that retains and houses the diaphragm and the magnetic circuit with the diaphragm being exposed therefrom, and a lid that forms a space between the lid and a surface of the case, from which the diaphragm is exposed, and includes an opening for spilling sound from one end of the space in a direction orthogonal to a slide direction of the slider block.

DESCRIPTION OF SYMBOLS

10 headband
20R. 20L slider block
21 slider base
22 slider cover
24 speaker unit
24, 24 speaker unit
30R. 30L hanger
31 first coupling portion
32 second coupling portion
33 shaft portion
34 forked portion
35 shaft portion
40R. 40L housing block
41 baffle
42 housing
43 ear pad
44, 44 headphone unit
100 headphone type acoustic apparatus
110 processor
112 memory
114 user operation section
116 flash memory
118 headphone amplifier
119 speaker amplifier
241 speaker driver unit
242 upper case
243 lower case
244 speaker cover
245 speaker grille
247 sound spill port
248 slit opening

The invention claimed is:

1. A headphone type acoustic apparatus, comprising:

a headband having two end portions;

a pair of slider blocks, wherein each slider block of the pair of slider blocks includes:

a first end portion;

a second end portion; and a speaker unit, wherein the first end portion of each slider block is coupled to a corresponding end portion of the two end portions of the headband, and wherein each slider block is configured to slide on the headband;

a pair of housing blocks, wherein each housing block of the pair of housing blocks is coupled to the second end portion of a corresponding slider block of the pair of slider blocks via coupling portions, and wherein each housing block of the pair of housing blocks includes a headphone unit;

an operation section configured to receive a switching instruction from a user; and a control unit configured to selectively drive the headphone unit included in the pair of housing blocks and the speaker unit included in the pair of slider blocks, based on the received switching instruction.

2. The headphone type acoustic apparatus according to claim 1, further comprising:

a first amplifier configured to amplify a first audio signal supplied to the headphone unit; and a second amplifier configured to amplify a second audio signal supplied to the speaker unit, wherein the control unit is further configured to switch between the first amplifier and the second amplifier based on the received switching instruction.

3. The headphone type acoustic apparatus according to claim 1, wherein the speaker unit includes:

a speaker driver unit including:

a diaphragm configured to vibrate in a thickness direction of the corresponding slider block of the pair of slider blocks;

a magnetic circuit configured to drive the diaphragm; and a case configured to house the diaphragm and the magnetic circuit, wherein a portion of the diaphragm is exposed from a first surface of the case; and a lid, wherein a space is present between the lid and the first surface of the case, and wherein the lid includes an opening to spill sound from a first end of the space in a direction orthogonal to a slide direction of the corresponding slider block.

4. The headphone type acoustic apparatus according to claim 3, wherein the first end of the space in the direction orthogonal to the slide direction of the corresponding slider block is on a front side in a state in which the headphone type acoustic apparatus is worn by the user.

5. The headphone type acoustic apparatus according to claim 3, wherein each slider block further includes:

a cushion member, wherein the cushion member is attached to the case included of the speaker unit.

6. The headphone type acoustic apparatus according to claim 1, wherein the coupling portions include:

a first coupling portion; and a second coupling portion, wherein the second coupling portion is configured to enable each housing block to rotate in a first axis direction orthogonal to a second axis direction of the first coupling portion.

7. The headphone type acoustic apparatus according to claim 1, wherein the control unit is further configured to:

drive the headphone unit based on a first amplifier configured to amplify a first audio signal supplied to the headphone unit; and drive the speaker unit based on a second amplifier configured to amplify a second audio signal supplied to the speaker unit.

8. An headphone type acoustic apparatus, comprising:

a headband having two end portions;

a pair of slider blocks, wherein each slider block of the pair of slider blocks includes:

a first end portion;

a second end portion; and a speaker unit, wherein the first end portion of each slider block is coupled to a corresponding end portion of the two end portions of the headband, and wherein each slider block is configured to slide on the headband;

a pair of housing blocks, wherein each housing block of the pair of housing blocks is coupled to the second end portion of a corresponding slider block of the pair of slider blocks via coupling portions, and wherein each housing block of the pair of housing blocks includes a headphone unit;

a first amplifier configured to amplify a first audio signal supplied to the headphone unit;

a second amplifier configured to amplify a second audio signal supplied to the speaker unit;

an operation section configured to receive a switching instruction from a user; and a control unit configured to switch between the first amplifier and the second amplifier based on the instruction received by the operation section.

* * * * *